United States Patent [19]

Aeppli

[11] 4,184,769

[45] * Jan. 22, 1980

[54] DETERMINATION OF YARN DEFECTS

[75] Inventor: Kurt Aeppli, Uster, Switzerland

[73] Assignee: Zellweger Uster, Ltd., Switzerland

[ * ] Notice: The portion of the term of this patent subsequent to Feb. 8, 1994, has been disclaimed.

[21] Appl. No.: 720,493

[22] Filed: Sep. 3, 1976

Related U.S. Application Data

[63] Continuation-in-part of Ser. No. 544,005, Jan. 24, 1975, Pat. No. 4,007,457.

[30] Foreign Application Priority Data

Oct. 2, 1975 [CH] Switzerland ..... 12779/75

[51] Int. Cl.[2] ..... C08B 21/00

[52] U.S. Cl. ..... 356/430; 66/163; 250/572

[58] Field of Search ..... 66/163, 125 R; 250/571, 250/572; 356/199, 200, 427, 430

[56] References Cited

U.S. PATENT DOCUMENTS

| | | | |
|---|---|---|---|
| 3,509,349 | 4/1970 | Molines et al. | 356/200 |
| 3,975,644 | 8/1976 | Scharf | 250/572 |
| 4,007,457 | 2/1977 | Aeppli | 66/163 |

*Primary Examiner*—John K. Corbin
*Assistant Examiner*—R. A. Rosenberger
*Attorney, Agent, or Firm*—Craig and Antonelli

[57] ABSTRACT

In a method and apparatus for the detection of yarn defects, which may be effected in combination with a standard yarn clearer or independently thereof, the cross section of the yarn is continuously scanned and an electrical signal is generated representing not only the cross section and length of yarn defects, but also their frequency or periodicity, and these features are used as the criterion for generating a defect signal as an indication of detection of regular or irregular sequences of thick places in the yarn.

17 Claims, 2 Drawing Figures

DETERMINATION OF YARN DEFECTS

Figure 1:
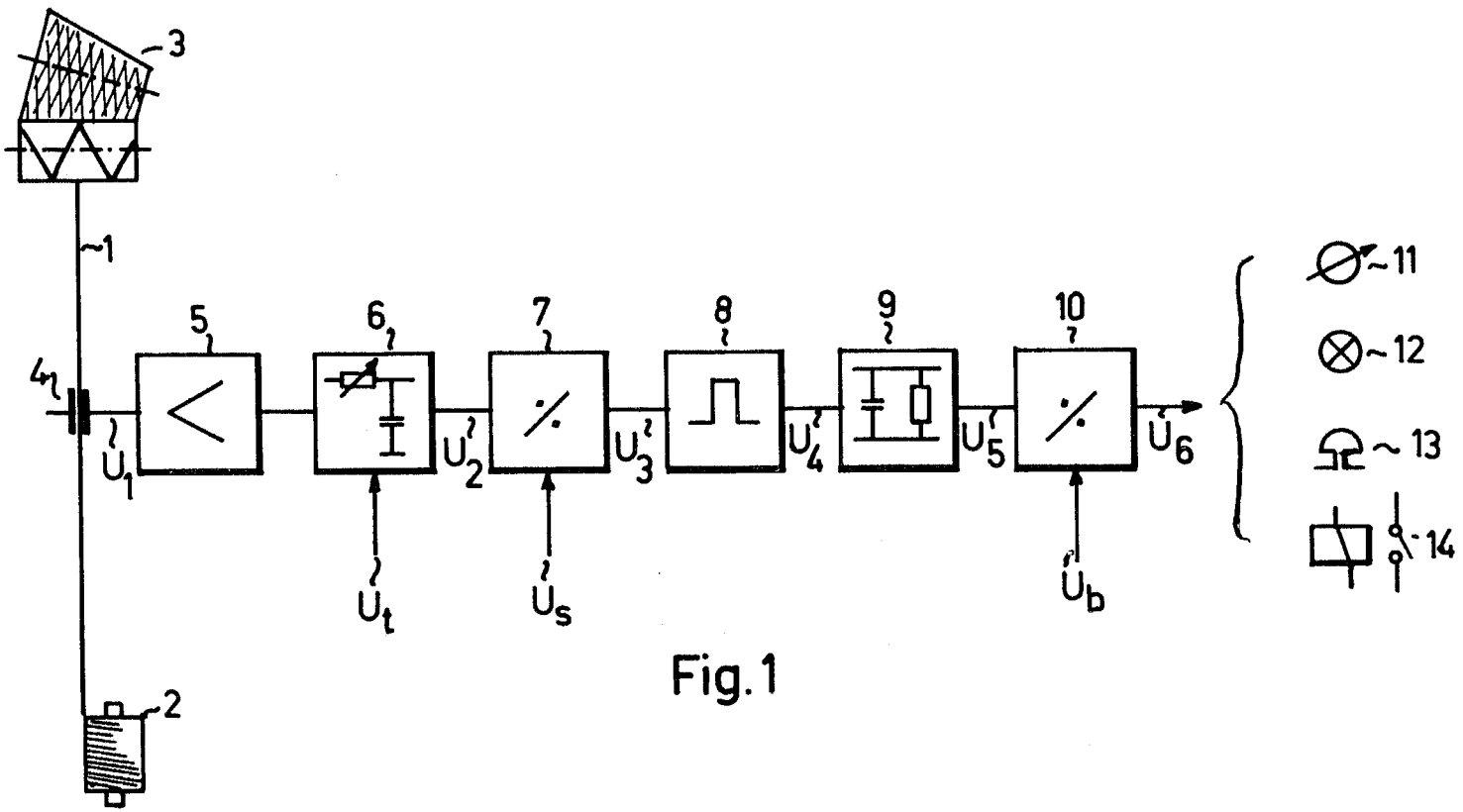

This application is a continuation in part of Ser. No. 544,005 filed on Jan. 24, 1975, which issued as U.S. Pat. No. 4,007,457 on Feb. 8, 1977.

This invention relates to a method and apparatus for the determination of yarn defects.

Simple mechanical devices are known which seek to determine and eliminate thick places in yarn by pulling the yarn through a slot adjusted according to the normal yarn diameter. Such a device, called a yarn clearer, assesses the yarn cross section as the only criterion.

In addition, devices are also known, and in many cases in use, in which the yarn cross section is measured optically, capacitively or by means of another medium and transformed into an electrical signal which corresponds to the particular yarn cross section. If the cross section signal then exceeds a predetermined value, the duration of the excess values is also determined and goes into the measurement value. Such devices can therefore assess both cross section and also the lengths of any thick or thin places in the yarn, and these yarn clearers generally guarantee a satisfactory yarn quality. However, they fail in all cases in which a regular or irregular sequence of defects of small cross section and small length is present. Individual examples of such defects are not in themselves disruptive; and to cut out each small defect is not practical. A corresponding yarn clearer of known type is therefore adjusted so that it does not respond to thick places of this type. Only after detection of the multiple repetition of such defects at intervals of decimeters or meters does this lead to the corresponding yarn being considered unusable.

Still more disruptive is the case of periodic repetition, i.e., the occurrence of such thick places at strictly uniform intervals. A fabric produced from such yarn then has the so-called Morie effect, which is also visible when the individual thick places disappear in the general uneveness characteristic of the yarn. These thick places cannot therefore be determined by standard measurement technology merely by shifting the response limit of the yarn clearer near to the average yarn cross section. As the very disruptive Morie effect is only formed when sufficiently large yarn lengths are processed, it is necessary for the determination of such regular or irregular sequences of thick places to extend over correspondingly long yarn sections.

The present invention takes into account these requirements and provides a method for determining yarn defects, in which the yarn cross section is continuously scanned by means of suitable feeler elements of other type of converter device and is converted into a corresponding electrical signal. The invention is characterized in that, in addition to the cross section and length of the yarn defects, their frequency and periodicity is checked and used as a criterion for initiating a signal in the event of the occurrence of regular or irregular sequences of thick places and/or a display means is activated as an indication of this defective yarn.

The invention also provides an apparatus for the implementation of this method, the said apparatus having a transmission channel at the input of which the signal corresponding to the yarn cross section is introduced and sufficiently amplified, a frequency dependent element operable as an adjuster for only operating the defects having a predetermined minimum defect length, a first comparator for the adjustment of the defect amplitude to which the channel is responsive, a monostable multivibrator for shaping the comparator output, an integrator for determining fault frequency and magnitude, a further comparator for detecting the integrated value and a display or signal device for indicating an alarm condition.

The method and apparatus of the invention are advantageously used as an addition to known yarn clearers. Thus arranged, they form an additional evaluation facility for monitoring the yarn quality.

Depending on the character of the yarn defect thus determined it may be of further advantage if the yarn defects ascertained in this transmission channel activate their own display or signal device, which is independent of the actual function of the yarn clearer. It would be little help if in the event of the occurrence of yarn defects whose signals are able to pass the transmission channel according to the invention, there took place only a yarn cut and a piece of the defective yarn were removed. This would be unusable yarn, but the cause of this type of yarn defect should be sought as a fault in the spinning process, which should be eliminated at the source. For this purpose, an indication or signal display showing that such a fault has been detected is more suitable than merely cutting out a piece of yarn, which will shortly be followed by another such piece.

It is an object of the present invention to provide a method and apparatus for detection of yarn defects which not only responds to the detected cross section and length of yarn defects, but also to the frequency or periodicity thereof.

It is another object of this invention to provide a method and apparatus for detection of regularly or irregularly occurring sequences of thick places in a yarn.

It is a further object of the present invention to provide a method and apparatus for detection of yarn defects which may be used in combination with a standard yarn clearer or independently thereof.

Figure 2:
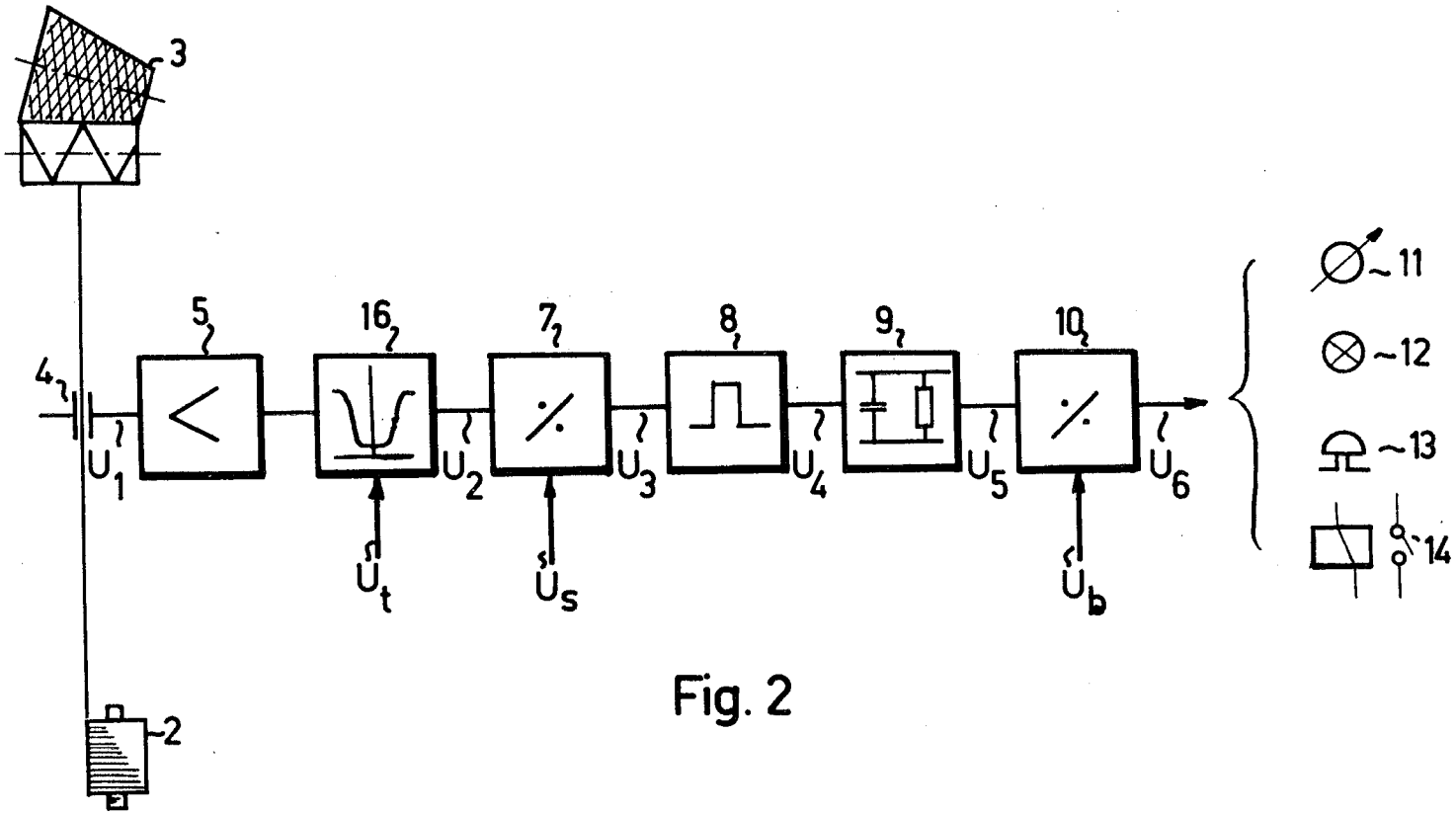

These and other objects, features, and advantages of the present invention will become more apparent from the following detailed description thereof when taken in conjunction with the accompanying drawings, in which:

FIG. 1 is a schematic diagram of a transmission channel in accordance with the present invention; and FIG. 2 is a schematic diagram of another embodiment of the transmission channel in accordance with this invention.

Referring to FIG. 1, a yarn 1 to be monitored is taken off a bobbin 2 and wound in a known manner on a parallel bobbin 3. In so doing, the yarn 1 runs through a measurement device 4 in the form of a converter having an output which represents the cross section of the yarn as an electrical signal U1. Such converters are well known in the art and operate on different principles, such as variable capacitance, variable inductance, air pressure variations, resonant frequency variations, optical indications, etc.

This signal U1 is raised to a suitable voltage level in an amplifier 5. The amplifier 5 is followed by a low pass filter 6 with an adjustable band pass. The adjustment of the band pass by means of a control value Ut determines the length of the defect so that in this low pass filter, signals representing short defects which should not pass through the transmission channel are suppressed. In this regard, the low pass filter 6 has an adjustable time constant $\tau = RC$ in the range of the transition time of a yarn fault through the measuring device, which yarn fault should be suppressed.

The signals U2 passing the low pass filter 6 reach a first comparator 7. The amplitude of the signals U2 is compared with an adjustable ideal value Us in this comparator which may be adjustable for cross section increases from 20% to 300%. If the amplitude exceeds the ideal value Us, a signal U3 is transmitted to a monostable multivibrator 8. This monostable multivibrator generates a pulse U4 of constant amplitude and duration.

The pulses U4 received from the multivibrator 8 are added up in an integrator 9; however, during the pulse gaps, the pulse sum stored in the integrator is at least partially discharged. The output voltage U5 of the integrator 9 acts on a second comparator 10 which is controlled by a reference signal Ub.

If only single pulses U4 occur at the output of monostable multivibrator 8 at widely spaced intervals, the integration of these pulses cannot result in a voltage level having the value of the reference signal Ub. However, if the pulses U4 follow one another at relatively short intervals, which signifies an accumulation of yarn defects the integrator becomes increasingly charged until in the comparator 10 the reference signal Ub is reached or exceeded, as a result of which a defect signal U6 is initiated. This defect signal U6 can then be used to activate a suitable display or signal device, such as a method instrument 11, a lamp 12, an alarm 13, or a relay 14 for initiating further switching functions, or a combination thereof.

FIG. 2 shows a further embodiment of the transmission channel, which is advantageously used when preferably periodic defects are to be determined. In this case the low pass filter 6 according to FIG. 1 is replaced by a band pass filter 16, which is tuned to the corresponding repetition frequency. This repetition frequency is advantageously made adjustable by a control signal Up supplied from outside, so as to be able to pick up periodicities over a certain frequency range. The remaining component elements and their functions are unchanged from those in FIG. 1.

The band pass of filter 16 is to be adjusted at the repetition frequency of the yarn faults. However, it is more advantageous to use a band pass filter which will pass not only the repetition frequency but all harmonics of this frequency. In this way, the complete frequency spectrum of the repetition frequency contributes to the output signal U2, and therefore, a very strong standard is obtained for periodically occurring yarn faults.

The method and apparatus of the invention can in themselves form a monitoring installation, with which the yarn 1 running through the measurement element 4 is examined merely for yarn defects consisting of a regular or irregular sequence of thick points. Such an arrangement is used when yarn production is already so perfect that other yarn defects, such as sporadic thick places, of all kinds, or double threads no longer occur.

The method and apparatus of the invention can, however, also form an addition to existing yarn clearers or yarn clearing installations which shows up a type of defect which could not be picked up with the conventional clearing equipment.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. A method for the detection of yarn defects after the spinning thereof, comprising the steps of continuously running the yarn through a conventional yarn clearer system to remove thick places greater than a particular cross section in the yarn, continuously scanning the yarn as it passes a detection point, producing an electrical signal representing the cross section of the yarn passing said detection point, analyzing said electrical signal to determine the length and periodicity of defects in the yarn, and indicating detection of a defective yarn on the basis of occurrence of only predetermined sequences of thick places that approximate periodic defects that would be caused by the yarn spinning process itself in the yarn as determined from analysis of said electrical signal over a period of time.

2. A method for the detection of yarn defects, as defined in claim 1, wherein said step of indicating detection of a defective yarn includes activation of a display producing a visual indication of the detection of the defective yarn.

3. A method for the detection of yarn defects, as defined in claim 1, wherein the step of analyzing includes the step of detection of regular sequences of thick places having at least a predetermined length and occurring at least at a predetermined frequency in the yarn.

4. A method for the detection of yarn defects, as defined in claim 1, wherein said step of analyzing includes the step of detection of irregular sequences of thick places having at least a predetermined length and occurring at least at a predetermined frequency in the yarn.

5. A method for the detection of yarn defects to be performed in combination with and as an addition to the functioning of a standard yarn clearer, comprising the steps of producing an electrical signal representing the cross section of the yarn as it passes through said yarn clearer, analyzing said electrical signal to determine the length and periodicity of defects in the yarn, detecting the occurrence of only predetermined sequences of thick places having at least a predetermined length and occurring at least at a predetermined frequency in the yarn which would approximate the periodic defects that would be caused by the yarn spinning process itself, and indicating presence of a defective yarn as determined from said analysis and detection of the yarn.

6. A method for the detection of yarn defects as defined in claim 5 wherein said step of indicating detection of a defective yarn includes activation of a display producing a visual indication of the detection of the defective yarn.

7. A yarn processing apparatus comprising:

conventional means for removing defects having a predetermined cross section in the yarn, detection means connected to said conventional defect removing means for detecting defects in yarn moving past a detection point in said detection means and producing an electrical signal representing the cross section of the yarn, filter means responsive to the output of said detection means for passing only signal components in a selectively adjustable frequency range representing defects of only predetermined length and occurring at least at a predetermined frequency in the yarn which would be caused by the yarn spinning process itself, first comparator means for producing an output only when the signal components passed by said filter means exceed a predetermined amplitude, monostable multivibrator means connected to the output of said first comparator means, integrator means connected to the output of said multivibrator means, and second comparator means for producing a defect signal when the output of said integrator means exceeds a predetermined level.

8. An apparatus as defined in claim 7, wherein said filter means is a variable low pass filter.

9. An apparatus as defined in claim 7, wherein said filter means is a variable band pass filter.

10. An apparatus as defined in claim 7, further including display means responsive to said defect signal for providing a visual indication of detection of a defective condition of said yarn.

11. In combination with a yarn clearer, an apparatus for the detection of both regularly and irregularly occurring sequences of thick places in a yarn comprising:

means for generating an electrical signal representing the cross section of the yarn, means for analyzing said electrical signal to determine the length and periodicity of defects in the yarn including detection means for detecting the occurrence of only predetermined sequences of thick places having at least a predetermined length and occurring at least at a predetermined frequency in the yarn that would approximate periodic defects that would be caused by the yarn spinning process itself, and indicating means responsive to said detection means for indicating detection of a defective condition of said yarn.

12. An apparatus as defined in claim 11 wherein said indicating means includes a combination of indicating elements of different type operable independently of said yarn clearer.

13. An apparatus as defined in claim 11 wherein said detection means comprises frequency-dependent means for passing only components of said electrical signal which fall within a selectively adjustable frequency range representing defects of predetermined length.

14. An apparatus as defined in claim 13 wherein said detection means further comprises first comparator means for producing an output signal upon receipt of a signal component exceeding a predetermined amplitude from said frequency dependent means, and a monostable multivibrator connected to the output of said first comparator means.

15. An apparatus as defined in claim 14 wherein said detection means further comprises an integrator connected to the output of said monostable multivibrator, and second comparator means for producing a defect signal when the output of said integrator exceeds a predetermined level.

16. An apparatus as defined in claim 13 wherein said frequency dependent means comprises a variable low pass filter.

17. An apparatus as defined in claim 13 wherein said frequency dependent means comprises a variable band pass filter.

* * * * *